US007823222B2

(12) United States Patent
Grilliot et al.

(10) Patent No.: US 7,823,222 B2
(45) Date of Patent: Nov. 2, 2010

(54) HOOD WITH ADAPTIVE FACE OPENING

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 11/708,181

(22) Filed: Feb. 20, 2007

(65) Prior Publication Data

US 2008/0196146 A1 Aug. 21, 2008

(51) Int. Cl.
*A42B 1/04* (2006.01)
*A42B 1/18* (2006.01)

(52) U.S. Cl. ..... 2/202; 2/173; 2/206

(58) Field of Classification Search ..... 2/202, 2/270, 9, 410, 7, 8.1, 8.2, 417, 419, 171, 2/171.4, 171.5, 183, 909, 918, 91, 203, 173, 2/206

See application file for complete search history.

(56) References Cited

U.S. PATENT DOCUMENTS 768,626 A * 8/1904 Rautenberg ..... 2/205
1,650,258 A * 11/1927 Bloomfield ..... 2/172
3,717,882 A * 2/1973 Schuessler ..... 2/173
3,740,767 A * 6/1973 Schuessler ..... 2/173
3,768,100 A * 10/1973 Colman et al. ..... 2/9
5,091,996 A * 3/1992 Kirby ..... 2/206
5,109,549 A * 5/1992 Mattinson ..... 2/202
6,081,925 A * 7/2000 Reiber ..... 2/125
6,209,144 B1 * 4/2001 Carter ..... 2/458
6,269,489 B1 * 8/2001 Heath ..... 2/173
6,427,244 B1 * 8/2002 Speier et al. ..... 2/104
2005/0273916 A1 * 12/2005 Kuhn ..... 2/428

* cited by examiner

*Primary Examiner*—Gary L Welch
*Assistant Examiner*—Amber R Anderson
(74) *Attorney, Agent, or Firm*—Wood, Phillips, Katz, Clark & Mortimer

(57) ABSTRACT

A protective hood is provided for covering at least a portion of a wearer's head. The hood includes an upper head covering section, a posterior head covering section, a neck covering section and an anterior head covering section. The anterior head covering section includes a window through which a portion of the wearer's face is exposed. The window is adjustable from a first position to a second position, exposing different portions of the wearer's face.

16 Claims, 1 Drawing Sheet

HOOD WITH ADAPTIVE FACE OPENING

BACKGROUND OF THE INVENTION

1. Technical Field

This invention pertains to a protective hood, such as a firefighter's hood, which may have a depending shroud to protect the neck of the wearer, and in more particular applications to a protective hood with an adaptable window for exposing portions of the wearer's face.

2. Background Art

Protective hoods, such as those used by firefighters are exemplified in U.S. Pat. Nos. 4,972,520, 5,090,054, 5,873,132 and 6,662,375, the disclosures of which are incorporated herein by reference, and are available commercially from Morning Pride Manufacturing, L.L.C. of Dayton, Ohio. Additionally, protective hoods are also used by others such as race car drivers, rescue workers and others.

Oftentimes, these individuals, particularly firefighters, have multiple protective hoods for use with different types of equipment and for use in different situations. For example, firefighters may have one protective hood for use with a self contained breathing apparatus (SCBA) which covers the eyes, nose and mouth of the firefighter. The hood in this instance should generally permit the wearer's eyes nose and mouth to be exposed through the hood to properly seal with the SCBA. This type of equipment is generally used in house fires.

However, there are often situations where it is not required to use an SCBA where the wearer may instead simply wear goggle or other protective eyewear. Therefore, the wearer does not need to have his or her nose and mouth exposed through the protective hood.

SUMMARY OF THE INVENTION

In one form, a protective hood for covering at least a portion of a wearer's head is provided. The hood includes an upper head covering section, a posterior head covering section, a neck covering section and an anterior head covering section. The anterior head covering section includes a window through which a portion of the wearer's face is exposed. The window has an upper portion and a lower portion and is adjustable from a first position to a second position by bringing the lower portion towards the upper portion and/or the upper portion towards the lower portion. The window is maintained in the second position by a releasable fastener.

According to one form, a protective hood for covering at least a portion of a wearer's head is provided. The hood includes an upper head covering section, a posterior head covering section, a neck covering section and an anterior head covering section. The anterior head covering section covers at least a portion of the wearer's face and has a window through which a remainder of the wearer's face is exposed. The window has an upper portion and a lower portion. The window is adjustable from a first position, exposing a first remainder of the wearer's face, to a second position, exposing a second remainder of the wearer's face which is less than the first remainder. The window is adjustable from the first position to the second position by bringing the lower portion towards the upper portion and/or the upper portion towards the lower portion. The window is maintained in the second position by a releasable fastener.

In one form, when in the first position, the protective hood is suitable for use by the wearer with a self contained breathing apparatus.

According to one form, when in the second position, the protective hood is suitable for use by the wearer with goggles whereby the wearer's face is not exposed while wearing the protective hood and the goggles.

In one form, the releasable fastener includes at least one tab extending from one of the upper and lower portions of the window.

According to one form, the at least one tab is made of an elastic material.

In one form, the window is made of an elastic material.

According to one form, the releasable fastener includes at least one of a hook and loop fastener, a button, a snap and a zipper closure.

In one form, at least a portion of the upper head covering section is made of a perforated material.

Other objects, features, and advantages of the invention will become apparent from a review of the entire specification, including the appended claims and drawings.

DETAILED DESCRIPTION OF THE PREFERRED EMBODIMENT

Figure 1:
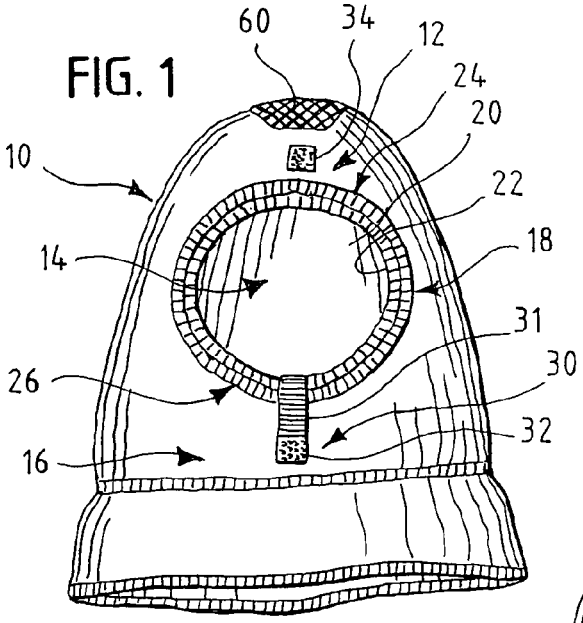
FIG. 1 is a front view of a protective hood having a window in a first position.

Referring to FIG. 1, a protective hood 10 for covering at least a portion of a wearer's head is provided. The hood 10 includes an upper head covering section 12, a posterior head covering section 14, a neck covering section 16 and an anterior head covering section 18.

The anterior head covering section 18 includes a window 20 through which a portion of the wearer's face is exposed. The window 20 is defined by a peripheral edge 22 and is adjustable between a first position (shown in FIGS. 1 and 2) and a second position (shown in FIGS. 3 and 4). The window 20 includes an upper portion 24, a lower portion 26, and spaced side edges between which a window width is defined. In one embodiment, the peripheral edge 22 is made of an elastic material such that the window 20 can elastically expand to the shape of the wearer's face.

Figure 3:
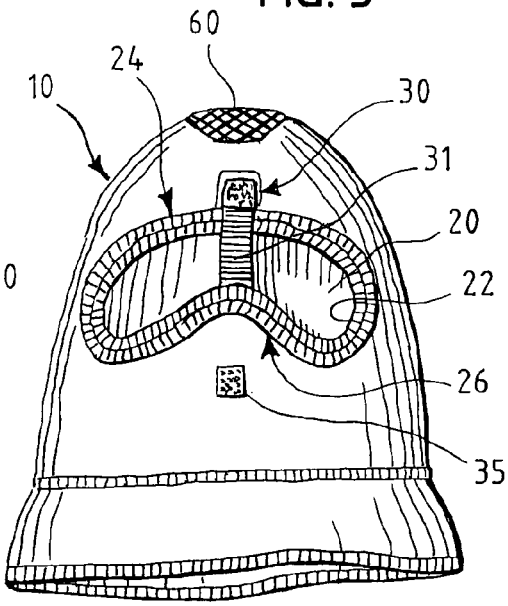
FIG. 3 is a front view of a protective hood having a window in a second position.
Figure 4:
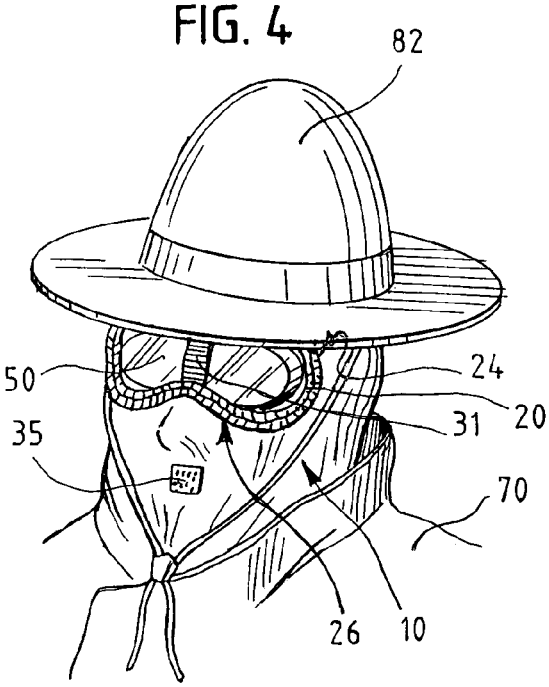
FIG. 4 is a front view of a protective hood having a window in a second position as worn by a wearer.

The hood 10 further includes a releasable fastener 30. In one embodiment, the releasable fastener includes at least one discrete tab 31 which can extend from one or both of the upper and lower portions 24,26. As seen in FIG. 1, the tab 31 extends from the lower portion 26 between the window side edges. As shown, the tab 31 is mid-way between the side edges. As illustrated in FIG. 1, the releasable fastener 30 is a hook and loop type fastener understood by those skilled in the art which has a hook portion 32 located adjacent the lower portion 26 and a loop portion 34 located adjacent the upper portion 24. It should be understood by those skilled in the art that the location of each of the hook and loop portions 32,34 may be located on the other of the upper and lower portions 24,26. Additionally, it should be understood that the releasable fastener may also include an additional loop portion 35 located adjacent the lower portion 26, as best seen in FIGS. 3 and 4.

Figure 5:
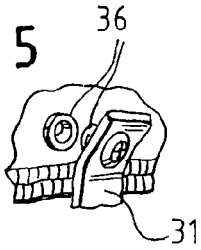
FIG. 5 is a fragmentary view of a releasable fastener for use with a protective hood.
Figure 6:
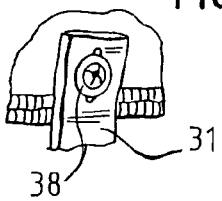
FIG. 6 is a fragmentary view of yet another embodiment of a releasable fastener for use with a protective hood.

Additionally, it should be understood by those skilled in the art that other forms of releasable fasteners 30 are also contemplated. Referring to FIGS. 5 and 6, additional releasable fasteners are shown, such as snaps 36 and buttons 38. However, other forms of releasable fasteners are also contemplated as known to those skilled in the art.

The hood 10 may further include a shoulder covering portion which extends downwardly from the neck covering section 16 to cover a portion of a wearer's shoulders.

Figure 2:
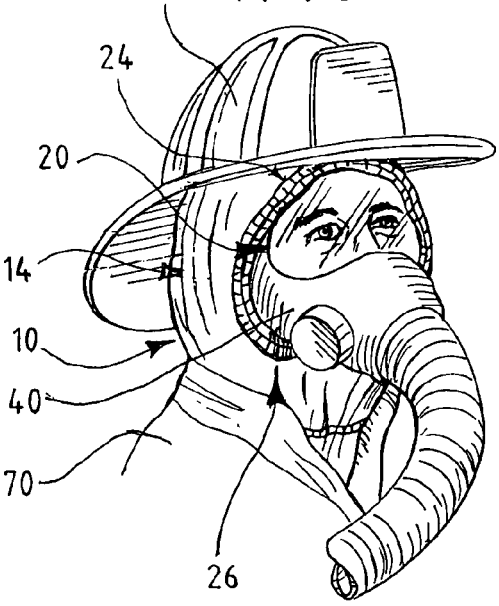
FIG. 2 is a front view of a protective hood having a window in a first position as worn by a wearer.

The first position is illustrated in FIGS. 1 and 2. As seen in these figures, in the first position a first remainder of the wearer's face is exposed through the window 20. Generally, the first position is suitable for use by a firefighter when wearing a self contained breathing apparatus (SCBA) 40. Oftentimes the SCBA 40 covers a majority of the wearer's face, including the wearer's eyes, nose and mouth. With this form of an SCBA, in the first position the window 20 exposes the wearer's eyes, nose and mouth, which are then covered by the SCBA 40, thereby leaving little, if any, of the wearer's face exposed. It should also be understood that the hood 10 in the first position may also be suitable for use with other equipment, such as masks, breathing filters and the like where it is desirable to have the nose and mouth of the wearer exposed to cooperate with the other equipment.

The second position is illustrated in FIGS. 3 and 4. The window 20 on the hood 10 is moved from the first position to the second position by grasping the tab 31 and drawing the tab 31 so as to thereby bring the lower portion 26 towards the upper portion 24 and/or the upper portion 24 towards the lower portion 26.

In the second position, a second remainder of the wearer's face is exposed through the window 20. It should be understood comparing FIGS. 2 and 4, that the second remainder of the wearer's face is less than the first remainder of the wearer's face exposed in the first position. In each position, the window is generally symmetrical in shape on opposite sides of a vertical line bisecting the width of the window. Specifically, in one embodiment, the wearer's nose and mouth are covered in the second position. As seen in these figures, the releasable fastener 30 is maintaining the hood 10 in the second position.

Generally, the second position is suitable for use by a firefighter in instances where the firefighter is not wearing an SCBA, mask or other equipment which interacts directly with the nose and/or mouth. For example, in FIGS. 3 and 4, the hood 10 is worn by a wearer, such as a forestry firefighter also wearing goggles 50. As seen in FIG. 4, the wearer does not need to have his or her mouth and/or nose exposed through the window 20. Additionally, it may be desired to have the mouth and/or nose covered to protect against heat and/or dust and other debris.

The hood 10 may be made of a variety of materials known to those skilled in the art such as Nomex. Generally, the materials chosen for the hood 10 should be fire resistant and thermally insulative to protect the wearer.

Correspondingly, the hood 10 may include multiple types of materials and/or layers depending upon the location on the hood and the desired use for the hood. Specifically, thicker and more insulative materials may be chosen for portions of the hood 10, such as the anterior section 18 which is more likely to be exposed to high temperatures. Optionally, at least a portion of the upper head covering section may be made of a perforated material, as illustrated by reference number 60 in FIGS. 1 and 3. In this instance, the upper portion of the wearer's head may be covered with a helmet and the perforated material 60 permits heat to escape from the wearer's head.

Generally, the protective hood 10 is worn with other protective garments such as a protective coat 70, which is shown in FIGS. 2 and 4, and a helmet 80,82. In this instance, the neck section 16 and optional shoulder covering section may be covered by the protective coat 70.

It should be understood that the protective hood 10 shown and described herein may be used in a variety of situations such as by firefighters, race car drivers, rescue workers and other individuals. It should be appreciated that for all of the disclosed embodiments there are many possible modifications that do not depart from the scope of the protective hood shown and described herein.

The invention claimed is:

1. A protective hood for covering a least a portion of a wearer's head, the hood comprising:

an upper head covering section;

a posterior head covering section;

a neck covering section; and, an anterior head covering section, the anterior head covering section having a window through which a portion of the wearer's face is exposed, the window having a width between spaced side edges, the window having an upper portion and a lower portion, the window being adjustable from a first position to a second position by bringing the lower portion towards the upper portion and/or the upper portion towards the lower portion, the window being maintained in the second position by a releasable fastener, the releasable fastener including at least one tab extending from one of the upper and lower portions of the window, the tab having a length that allows the upper and lower portions to be spaced from each other in the second position and located between the spaced side edges of the window.

2. The protective hood of claim 1 wherein in the second position, the protective hood is suitable for use by the wearer with goggles whereby the wearer's face is not exposed while wearing the protective hood and the goggles.

3. The protective hood of claim 1 wherein the at least one tab is made of an elastic material.

4. The protective hood of claim 1 wherein the window is made of an elastic material.

5. The protective hood of claim 1 wherein the releasable fastener includes at least one of a hook and loop fastener, a button, a snap and a zipper closure.

6. The protective hood of claim 1 wherein at least a portion of the upper head covering section is made of a perforated material.

7. The protective hood of claim 1 wherein the tab is located approximately mid-way between the side edges of the windows.

8. The protective hood of claim 1 wherein there is one and only one releasable fastener that is usable to maintain the window in the second position.

9. The protective hood of claim 1 wherein the one tab is a discrete tab that projects from the one of the upper and lower portion of the window to be grasped and drawn by a user to thereby change the position of the window.

10. A protective hood for covering a least a portion of a wearer's head, face and neck, the hood comprising:

an upper head covering section;

a posterior head covering;

a neck covering section; and, an anterior head covering section which covers at least a portion of the wearer's face, the anterior head covering section having a window with a width through which a remainder of the wearer's face is exposed, the window having an upper portion and a lower portion, the window being adjustable from a first position, exposing a first remainder of the wearer's face, to a second position, exposing a second remainder of the wearer's face which is less than the first remainder, the window being adjustable from the first position to the second position by bringing the lower portion towards the upper portion and/or the upper portion towards the lower portion, the window being maintained in the second position by a releasable fastener, the releasable fastener comprising a single tab extending from one of the upper and lower portions of the window to releasably connect to another part of the hood to maintain the window in the second position, the single tab having a length that allows the upper and lower portions to be spaced from each other in the second position, the single tab configured to be grasped and drawn by a user to thereby change the position of the window from the first position into the second position, the window in the second position having a generally symmetrical shape on opposite sides of a vertical line bisecting the width of the window.

11. The protective hood of claim 10 wherein in the second position, the protective hood is suitable for use by the wearer with goggles whereby the wearer's face is not exposed while wearing the protective hood and the goggles.

12. The protective hood of claim 10 wherein the at least one tab is made of an elastic material.

13. The protective hood of claim 10 wherein the window is made of an elastic material.

14. The protective hood of claim 10 wherein the releasable fastener includes at least one of a hook and loop fastener, a button, a snap and a zipper closure.

15. The protective hood of claim 10 wherein at least a portion of the upper head covering section is made of a perforated material.

16. A protective hood for covering a least a portion of a wearer's head, the hood comprising:

an upper head covering section;

a posterior head covering section;

a neck covering section; and, an anterior head covering section, the anterior head covering section having a window through which a portion of the wearer's face is exposed, the window having an upper portion and a lower portion, the window being adjustable from a first position to a second position by bringing the lower portion towards the upper portion and/or the upper portion towards the lower portion, the upper and lower portions spaced from each other in the second position, the window being maintained in the second position by a releasable fastener, the releasable fastener including at least one discrete tab extending from one of the upper and lower portions of the window and configured to be grasped by a user and moved to change the position of the window, the one tab releasably attachable to a part of the hood at the anterior head covering section to maintain the window in the second position.

* * * * *